US009370244B1

(12) United States Patent
Kumar

(10) Patent No.: US 9,370,244 B1
(45) Date of Patent: Jun. 21, 2016

(54) MULTI-FUNCTIONAL, RECONFIGURABLE FURNITURE SYSTEM FOR USE ON UNEVEN SURFACES

(71) Applicant: Sivathanu B. Kumar, Tampa, FL (US)

(72) Inventor: Sivathanu B. Kumar, Tampa, FL (US)

( * ) Notice: Subject to any disclaimer, the term of this patent is extended or adjusted under 35 U.S.C. 154(b) by 0 days.

(21) Appl. No.: 14/751,850

(22) Filed: Jun. 26, 2015

Related U.S. Application Data

(63) Continuation-in-part of application No. 14/457,736, filed on Aug. 12, 2014, now Pat. No. 9,066,588, which is a continuation-in-part of application No. 13/534,443, filed on Jun. 27, 2012, now Pat. No. 8,832,873, which is a continuation-in-part of application No. 12/802,086, filed on May 28, 2010, now Pat. No. 8,407,830.

(60) Provisional application No. 61/217,613, filed on Jun. 2, 2009.

(51) Int. Cl.

| | |
|---|---|
| ***A47B 85/00*** | (2006.01) |
| ***A47B 83/04*** | (2006.01) |
| ***A47B 96/02*** | (2006.01) |
| ***A47C 17/52*** | (2006.01) |

(52) U.S. Cl.
CPC ..... *A47B 85/00* (2013.01); *A47B 83/045* (2013.01); *A47B 96/02* (2013.01); *A47C 17/52* (2013.01)

(58) Field of Classification Search
CPC .... A47B 43/00; A47B 47/0091; A47B 85/00; A47B 85/06; A47B 83/045; A47B 96/02; A47C 17/52; A47C 19/205; A47C 27/001; A47C 27/081
USPC ..... 312/237, 240, 257.1, 235.2, 235.3, 312/234.4, 235.5, 313, 314, 315, 316, 312/317.1, 317.3; 5/2.1, 3, 5, 6, 7, 133, 5/136, 159.1, 160
See application file for complete search history.

(56) References Cited

U.S. PATENT DOCUMENTS

| | | | | |
|---|---|---|---|---|
| 117,632 | A * | 8/1871 | Hopfs | 5/2.1 |
| 266,860 | A * | 10/1882 | Meissner | 5/164.1 |
| 3,088,127 | A * | 5/1963 | Eames | 5/2.1 |
| 3,235,888 | A * | 2/1966 | Nystrom | 5/2.1 |
| 3,858,253 | A * | 1/1975 | Lauzon | 5/2.1 |
| 4,793,011 | A * | 12/1988 | Eve | 5/136 |
| 4,866,798 | A * | 9/1989 | Harris | 5/263 |
| 5,101,524 | A * | 4/1992 | Brandschain | 5/17 |
| 6,401,276 | B1 * | 6/2002 | Sherman | 5/136 |
| 6,851,139 | B2 * | 2/2005 | Arason et al. | 5/159.1 |
| 7,013,506 | B2 * | 3/2006 | Revels | 5/149 |
| 2003/0070224 | A1 * | 4/2003 | Walsh | 5/2.1 |
| 2006/0107456 | A1 * | 5/2006 | Joseph | 5/2.1 |
| 2007/0289225 | A1 * | 12/2007 | Kern et al. | 52/36.1 |
| 2011/0088163 | A1 * | 4/2011 | Luft-Weissberg | 5/2.1 |

* cited by examiner

*Primary Examiner* — James O Hansen

(57) ABSTRACT

A cabinet has an upper panel assembly and a parallel lower panel assembly, a left side panel assembly and a parallel right side panel assembly, and an intermediate plate providing an upper and a lower central opening. The upper central opening engages a selection of a user's choice of inter-changeable box-shaped modular units. The lower central opening provide housing including housing for an associated mattress. The cabinet is movable between horizontal and vertical orientations. In the horizontal orientation the repositionable support panels of the cabinet provide support for a mattress. In the vertical orientation, the cabinet includes a cabinet, desk, and a computer work station.

2 Claims, 6 Drawing Sheets

MULTI-FUNCTIONAL, RECONFIGURABLE FURNITURE SYSTEM FOR USE ON UNEVEN SURFACES

RELATED APPLICATIONS

This non-provisional application is a continuation-in-part of application Ser. No. 14/457,736 filed Aug. 12, 2014 issued Jun. 30, 2015 as U.S. Pat. No. 9,066,588, which is in turn, a continuation-in-part of application Ser. No. 13/534,443 filed Jun. 27, 2012 issued Aug. 27, 2014 as U.S. Pat. No. 8,832,873, which is, in turn, a continuation-in-part of application Ser. No. 12/802,086 filed May 28, 2010 issued Apr. 2, 2013 as U.S. Pat. No. 8,407,830, which is, in turn, based upon Provisional Application No. 61/217,613 filed Jun. 2, 2009.

BACKGROUND OF THE INVENTION

1. Field of the Invention

The present invention relates to a multi-functional, reconfigurable furniture system for use on uneven surfaces and more particularly pertains to a furniture system convertible from an attractive cabinet including a desk and computer work station when needed and alternatively converted to a bed upon necessity.

2. Description of the Prior Art

The use of reconfigurable furniture systems of known designs and configurations is known in the prior art. More specifically, reconfigurable furniture systems of known designs and configurations previously devised and utilized for the purpose of conversion from a cabinet to a bed are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, they do not describe a multi-functional, reconfigurable furniture system for use on uneven surfaces for use on uneven surfaces that can be converted to a cabinet including a desk and computer work station when needed and alternatively converted to a bed upon necessity.

In this respect, the multi-functional, reconfigurable furniture system for use on uneven surfaces according to the present invention substantially departs from the conventional concepts and designs of the prior art, and in doing so provides an apparatus primarily developed for the purpose being converted to a cabinet including a desk and computer work station when needed and alternatively converted to a bed upon necessity.

Therefore, it can be appreciated that there exists a continuing need for a new and improved multi-functional, reconfigurable furniture system for use on uneven surfaces which can be converted to a cabinet including a desk and computer work station when needed and alternatively converted to a bed upon necessity. In this regard, the present invention substantially fulfills this need.

SUMMARY OF THE INVENTION

In view of the disadvantages inherent in the known types of reconfigurable furniture systems of known designs and configurations now present in the prior art, the present invention provides an improved multi-functional, reconfigurable furniture system for use on uneven surfaces. As such, the general purpose of the present invention, which will be described subsequently in greater detail, is to provide a new and improved multi-functional, reconfigurable furniture system for use on uneven surfaces and method which has all the advantages of the prior art and none of the disadvantages.

To attain this, the present invention essentially comprises a multi-functional, reconfigurable furniture system for use on uneven surfaces for conversion to a cabinet including a desk and computer work station during the day and to a bed upon necessity. From a broad concept, the system includes a selection of a plurality of combination box-shaped modular units comprising shelving assemblies and box-shaped shelving assemblies, a cabinet movable between horizontal and vertical orientations, a plurality of resilient mattress members, and similarly configured support panels coupled to the cabinet.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multi-functional, reconfigurable furniture system which has all of the advantages of the prior art reconfigurable furniture systems of known designs and configurations and none of the disadvantages.

It is another object of the present invention to provide a new and improved multi-functional, reconfigurable furniture system for use on uneven surfaces which may be easily and efficiently manufactured and marketed.

It is a further object of the present invention to provide a new and improved multi-functional, reconfigurable furniture system for use on uneven surfaces which is of durable and reliable constructions.

An even further object of the present invention is to provide a new and improved multi-functional, reconfigurable furniture system for use on uneven surfaces which is susceptible of a low cost of manufacture with regard to both materials and labor, and which accordingly is then susceptible of low prices of sale to the consuming public, thereby making such multi-functional, reconfigurable furniture system for use on uneven surfaces economically available to the buying public.

An even further object of the present invention is that the components of this system are adapted to be reconfigured and repositioned to provide various functionalities and utilities including at least functioning as a cabinet for storage and display, a book shelf, a desk, a computer work station and a bed with a mattress and further designing the inter-changeable box-shaped modular units and further the components of the inter-changeable box-shaped modular units as a modular component whereby the users are provided with the choice to select preferred components, a plurality of components, a configuration of a combinations of components and also further allowing the users to replace or change the existing components at future times to meet their changing utility needs and preferences. Thus users are allowed to replace or change existing components and also add new components.

Lastly, it is an object of the present invention to provide a multi-functional, reconfigurable furniture system for use on uneven surfaces that can be converted to a cabinet including a desk and computer work station when needed and alternatively converted to a bed upon necessity.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
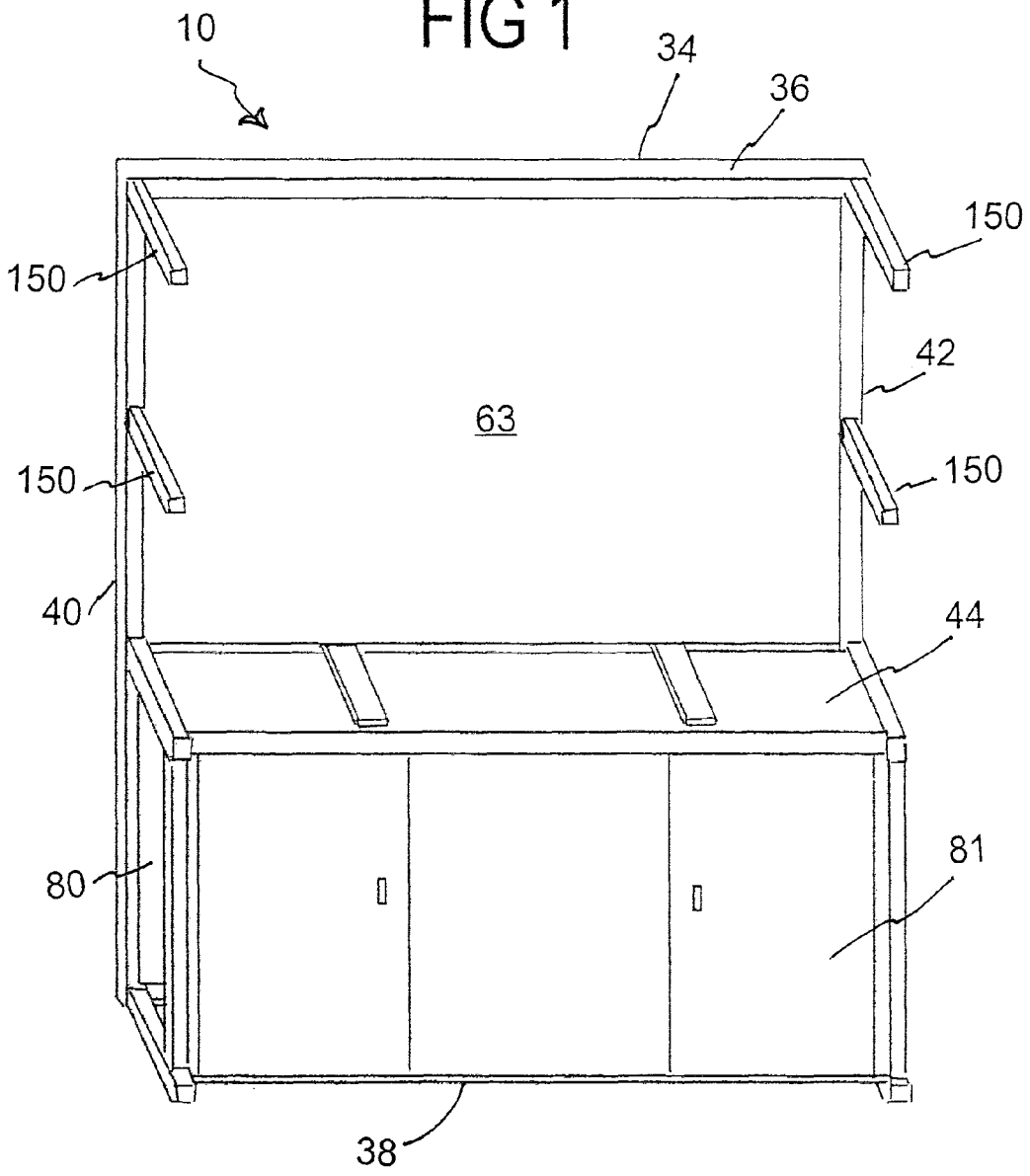
FIG. 1 is a perspective front view of a cabinet constructed in accordance with the principles of the present invention shown in a vertical orientation.
Figure 2:
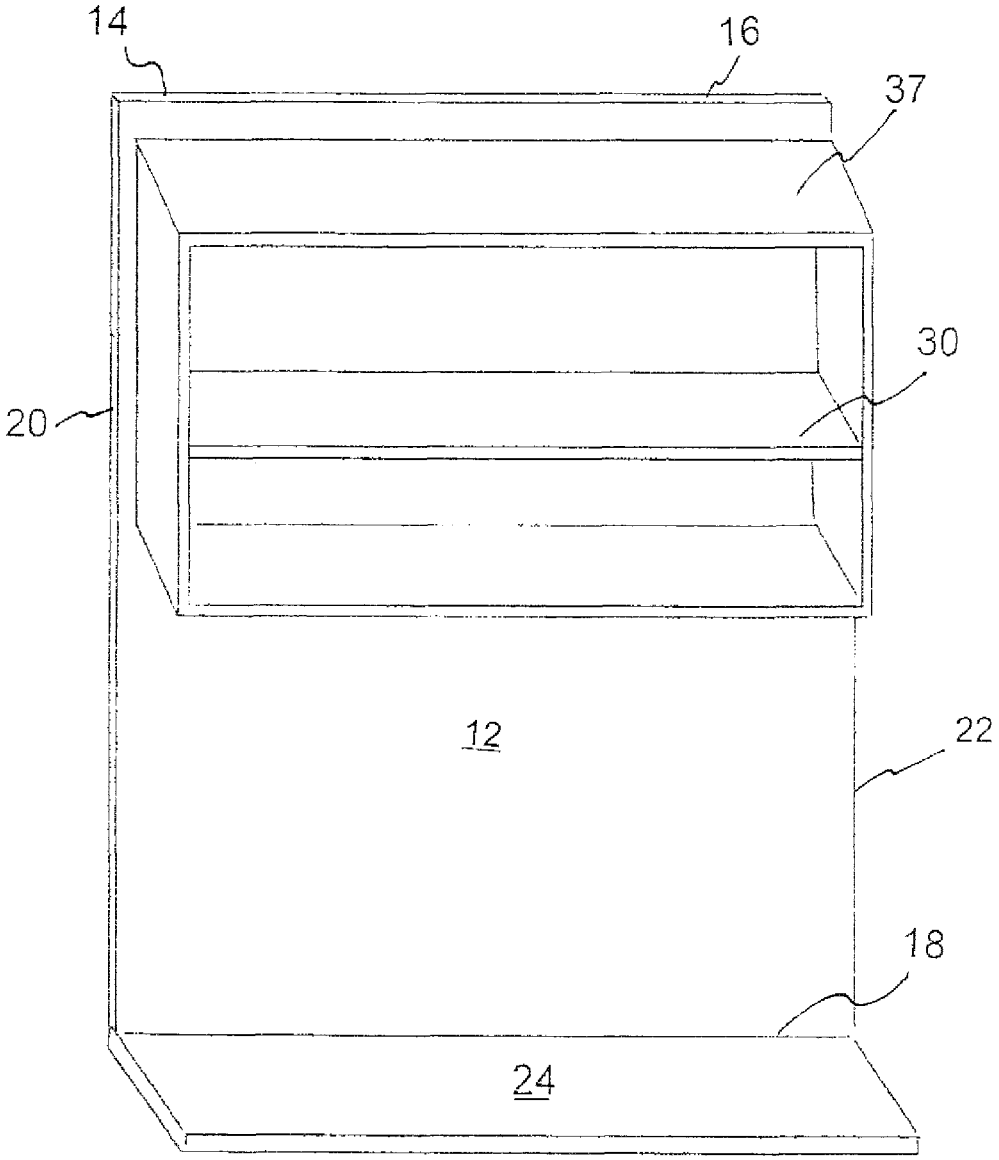
FIG. 2 is a perspective front view of the back plate in vertical orientation and illustrating the selective coupling of the interchangeable box-shaped modular units.
Figure 3:
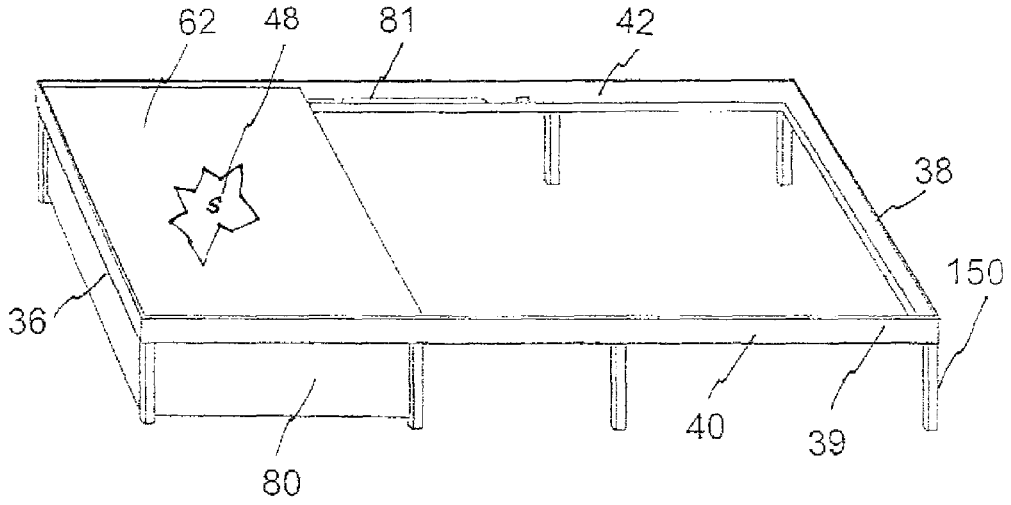
FIG. 3 is a perspective front view of the cabinet of the present invention shown in horizontal orientation.
Figure 4:
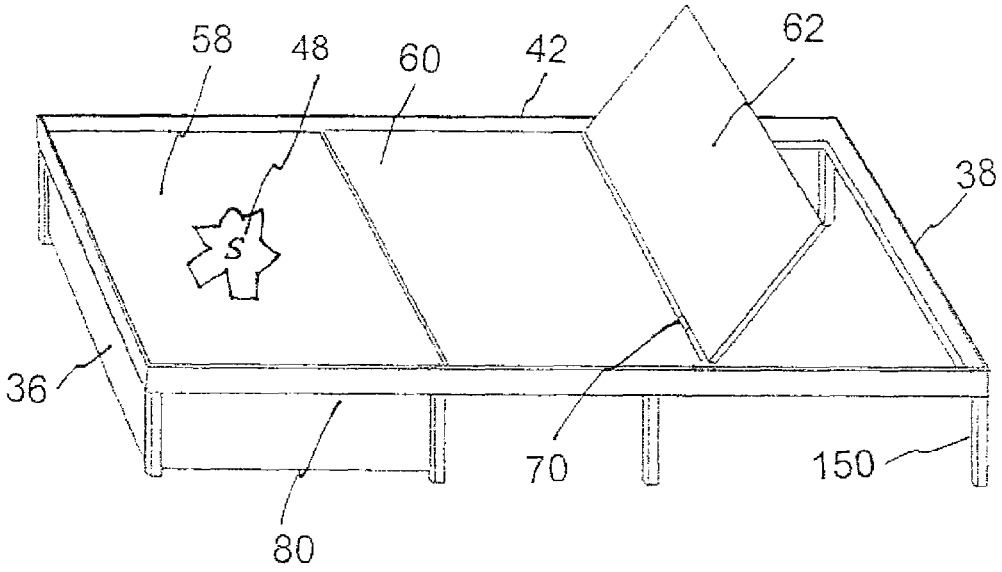
FIG. 4 is a perspective front view of the cabinet shown in FIG. 3, showing the middle support panel slidable in a second direction for re-positioning and spanning the openings.
Figure 5:
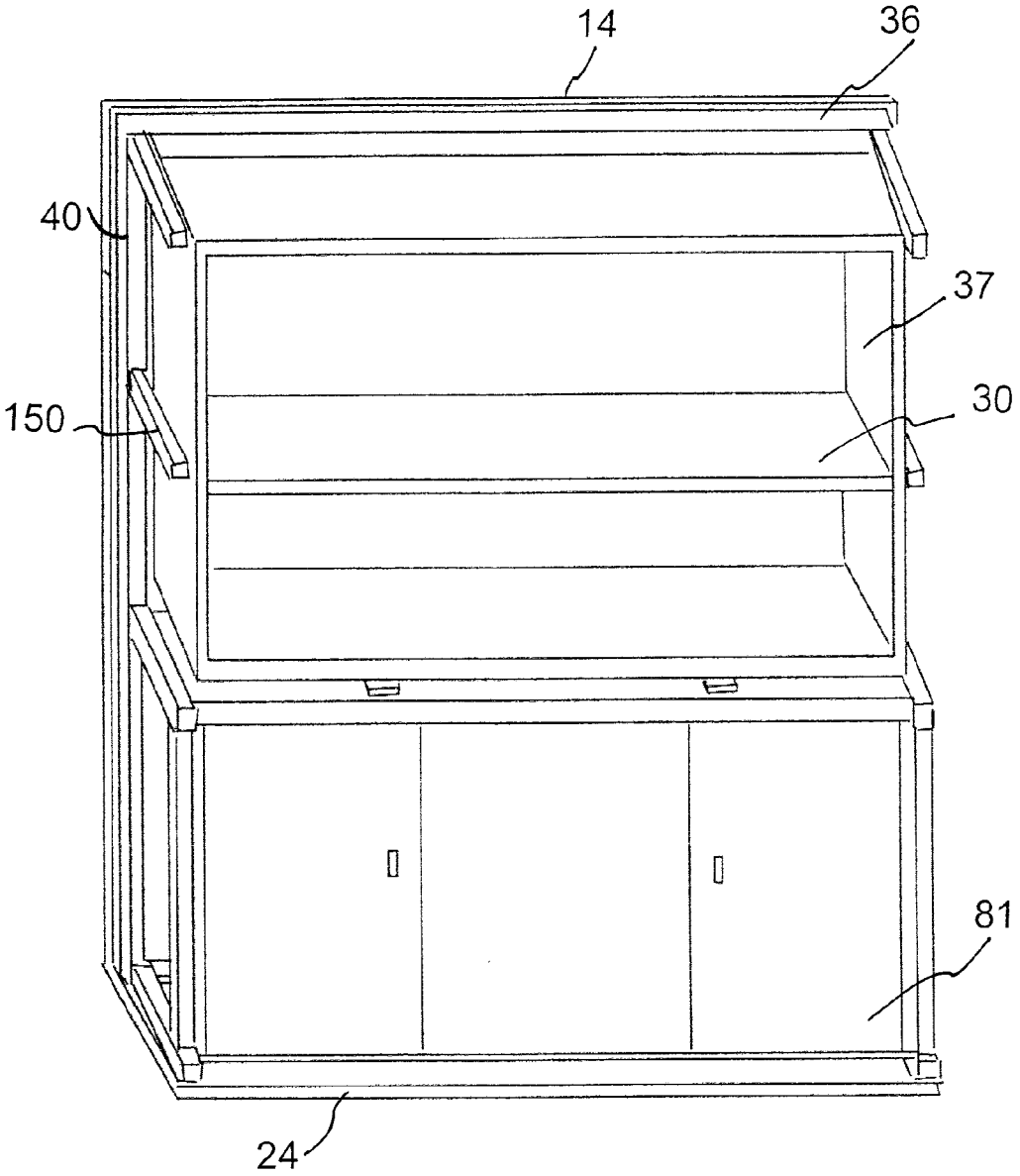
FIG. 5 is a perspective front view of the back plate with the modular shelving unit shown in FIG. 4 in position and the cabinet in FIG. 1 in a vertical orientation with the upper central opening engaging the interchangeable box-shaped modular units.
Figure 6:
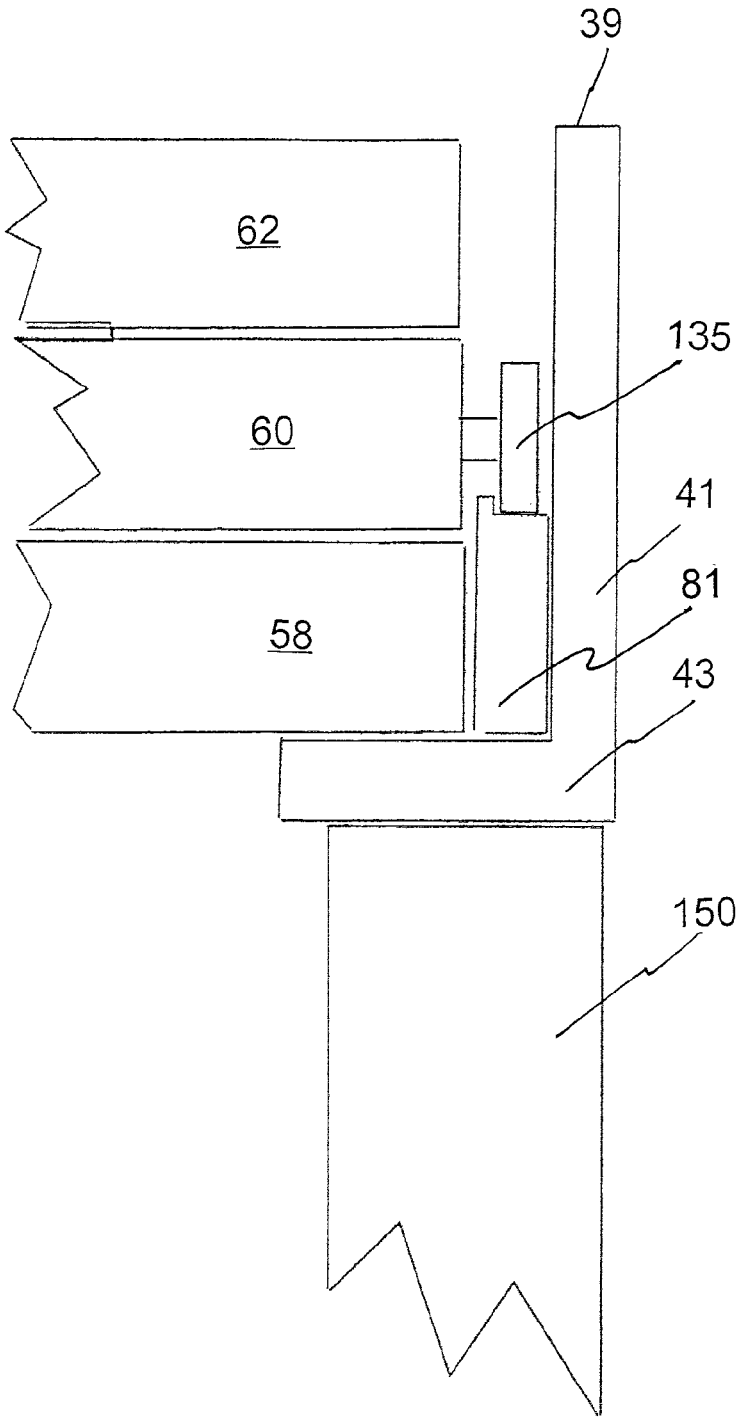
FIG. 6 is an exploded perspective view of the details of the similarly configured support panels coupled to the cabinet, the support panels including a lower panel, a middle panel, and an upper panel. The lower panel is coupled to the cabinet. The middle panel includes a stacking assembly having four laterally extending rollers.

With reference now to the drawings, and in particular to FIG. 1 thereof, the preferred embodiment of the new and improved multi-functional, reconfigurable furniture system for use on uneven surfaces embodying the principles and concepts of the present invention and generally designated by the reference numeral 10 will be described.

The present invention, the multi-functional, reconfigurable furniture system for use on uneven surfaces 10 is comprised of a plurality of components. Such components in their broadest context include a plurality of inter-changeable box-shaped modular units, a cabinet, a resilient mattress member, and support panels. Such components are individually configured and correlated with respect to each other so as to attain the desired objective.

The present invention is a multi-functional, reconfigurable furniture system for use on uneven surfaces 10 that can be converted to a cabinet including a desk and computer work station when needed and alternatively converted to a bed upon necessity.

First provided is a cabinet 34. The cabinet has a horizontal upper panel assembly 36 and a parallel lower panel assembly 38 separated by a height. The cabinet has a vertical left side panel assembly 40 and a parallel right side panel assembly 42 separated by a width. The length and width are generally greater than the width of a resilient mattress member associated with this system. When the cabinet is positioned in a horizontal orientation, the upper extent of the upper panel assembly, lower panel assembly, the left panel assembly and the right side panel assembly has a support frame 39. The support frame is comprised of laterally positioned vertical section 41. The lower edge of the vertical section has an inwardly projecting lower horizontal section 43. The lower surface of the horizontal section of the frame is coupled with downwardly extending legs 150 and the legs provide the height between the support frame 39 and the surface/floor upon which the cabinet is positioned. The materials for fabrication of the components of the frame are chosen from a class of materials for providing the necessary flexibility thus providing the frame with the flexibility to adapt to the uneven floor upon which the cabinet is positioned. In part and as a whole, the components of the frame are further designed, selected, and engineered to provide the specific and necessary amount of flexibility to adapt to unevenness of the surfaces upon which the cabinet is positioned.

The cabinet has an intermediate plate 44 that is parallel to the horizontal upper panel assembly 36 and the parallel lower panel assembly 38. Thus, an upper central opening 63 is formed between the upper panel assembly, the intermediate plate, the left side panel assembly, and the right panel assembly. Thus also, a lower central opening 80 is formed between the intermediate plate, the lower panel assembly, the right side panel assembly, and the right panel assembly.

The upper central opening is greater in dimension and generally is double the size of the lower central opening. The upper central opening receives and engages the inter-changeable modular shelving assemblies 30 and also other remote items and objects including television and pictures. The inter-changeable modular shelving assemblies 30 and remote items and objects including television and pictures can be secured to remote structures such as a wall. In the alternative, such objects can also be secured using the back plate assembly provided with this system.

The lower central opening is generally provided with doors in the front and back. The lower central opening 80 generally provides a chamber 48 for storage of a mattress that is being selected to be used with this system. The cabinet is movable between a horizontal orientation and a vertical orientation. In the horizontal orientation, the cabinet is positioned upon the floor with the upper and lower panel assemblies vertically oriented.

In the vertical orientation, the cabinet is positioned upon the bottom panel assembly and, alternatively, lateral to a remote structure including a wall or back plate assembly. Positioning in the vertical orientation is with the intermediate plate separating the inter-changeable modular shelving assemblies 30 from the housing 48 and with the upper and lower panel assembly horizontally disposed.

Next provided is a selection of inter-changeable box-shaped modular units 37 in a plurality of sizes, combinations and selections. This allows the user to choose the number of components, the type of components, and also the combination and the configuration of the components to meet users' specific needs and preference and the to meet the requirements for replacement and addition of new components at a future time. Further provided are a selection of a plurality of resilient mattress members. The mattress is adapted to be inserted into one of the housings. The mattress is placed upon the support panels 58, 60, 62 of the cabinet when the cabinet is in the horizontal orientation.

The cabinet is provided with similarly configured support panels 58, 60, 62 coupled to the cabinet. The support panels include a lower panel 58, middle panel 60, and an upper panel 62. The lower panel 58 is coupled to the cabinet. The middle panel 60 is provided with a stacking assembly. In this manner, the middle support panel is slidable in a first direction for positioning in a stacked orientation when the cabinet is in the vertical orientation and slidable in a second direction for re-positioning and spanning the opening of the horizontally oriented cabinet.

The upper panels 62 are provided with hinges 70 for folding and stacking the upper panel 62 upon the middle panel when the cabinet is in the vertical orientation. The support panels are re-positionable for spanning the openings when the cabinet is in the horizontal orientation. In this manner, the panels will totally cover the openings and provide full support for a resilient mattress.

Further provided is the back plate for receiving and securing inter-changeable modular shelving assemblies 30 and remote items and objects including television and pictures.

The back plate 14 has a horizontal upper edge 16 and a parallel lower edge 18 separated by a height which is generally greater than the width of a resilient mattress member associated and used with this system. The back plate has a vertical left side edge 20 and a parallel right side edge 22 separated by a width that is generally greater than the length of a resilient mattress member associated and used with this system. The back plate is vertically positionable and securable to a remote structure including a wall of a building. The foot plate 24 is attached to the lower edge of the back plate. The foot plate extends forwardly from the back plate. The width of the foot plate is generally equal to the width of the back plate. The back plate is formed with a front vertical central section 12. The front vertical central section of the back plate 14 is adapted to receive the inter-changeable box-shaped modular units 37 comprising shelving assemblies 30.

It should be understood that the furniture and associated mattresses of the system may be fabricated in various sizes, shapes, and functions. The furniture and mattresses have the means to be adapted to include such variations in size, materials, shape, form, function and manner of operation, assembly, and use. In this manner, the system may be configured in a variety of ways to include any number of a selection of inter-changeable box-shaped modular units. The system is meant to be adaptable to change from one configuration to another for use now for one function and again at a later time with different or additional components for another function.

It is within the scope of the invention to modify and engineer the components including the panels to reduce weight and to adapt the system for use with a plurality of sizes of mattresses and beds.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multi-functional, reconfigurable furniture system (10) for conversion to a cabinet including a desk and computer work station generally during the day and for conversion to a bed upon necessity, the system comprising, in combination:

a selection of inter-changeable box-shaped modular units (37) comprising a plurality of selection shelving assemblies (30) and box-shaped shelving assemblies, a cabinet (34) having a horizontal upper panel assembly (36) and a parallel lower panel assembly (38) separated by a height, the cabinet having a vertical left side panel assembly (40) and a parallel right side panel assembly (42) separated by a width, the dimension of the length and width are generally greater than the length and width of one of a plurality of resilient mattress members associated with the system, the cabinet having an intermediate plate (44), an upper central opening (63) between the upper panel assembly and the intermediate plate and between the left side panel assembly and the right panel assembly, a lower central chamber (80) between the intermediate lower plate and between the left side plate and the intermediate plate and the lower panel assembly and between the right side panel assembly and the left panel assembly, the lower central chamber being greater in dimension and generally double the size of the left central opening;

the cabinet positioned in a horizontal orientation, the upper extent of the upper panel assembly, lower panel assembly, the left panel assembly and the right side panel assembly having at least a support frame (39), the support frame generally comprising a lateral vertical section (41) and an inwardly projecting lower horizontal section, the lower surface of the horizontal section (43) of the frame having downwardly extending legs (150) providing a height between the support frame and the surface including the floor upon which the cabinet is positioned, materials for fabricating the components of the frame, in part and as a whole, being chosen from a class of materials providing specific flexibility to adapt to unevenness of the surfaces upon which the cabinet is positioned;

the upper central opening engaging the inter-changeable box-shaped modular units (37), the shelving assemblies (30) and the box-shaped shelving assemblies (31);

the cabinet being movable between a horizontal orientation and a vertical orientation, the horizontal orientation positioning the cabinet upon a floor with the upper and lower panel assembly vertically disposed, the vertical orientation positioning the cabinet upon the back plate (14) with the intermediate plate separating the inter-changeable modular shelving assemblies (30) and the box-shaped shelving assemblies (31) from the chamber (48) and with the upper and lower plates horizontally disposed;

the plurality of resilient mattress members adapted to be folded and inserted into one of the housings when the cabinet is in the vertical orientation and placed upon the cabinet when in the horizontal orientation;

similarly configured support panels (58) (60) (62) coupled to the cabinet, the support panels including a lower panel (58) and a middle panel (60) and an upper panel (62), the lower panel (58) coupled to the cabinet, the middle panel (60) including a stacking assembly whereby the middle support panel is slidable in a first direction for positioning in a stacked orientation when in the vertical orientation and slidable in a second direction for re-positioning and spanning the openings when in the horizontal orientation; and the upper panel (62) including hinges (70) for folding and stacking the upper panel (62) upon the middle plate when the cabinet is in the vertical orientation, the support panels re-positionable for spanning the upper central opening (63) when in the horizontal orientation, whereby the panels will totally cover the upper central opening (63) and provide full support for one of the plurality of resilient mattress members;

the back plate (14) having horizontal upper edge (16) and a parallel lower edge (18) separated by a height which is generally greater than the width of a resilient mattress member associated with the system, the back plate having a vertical left side edge (20) and a parallel right side edge (22) separated by a width that is generally greater than the length of resilient mattress member associated with the system, the back plate being vertically positionable; and a foot plate (24) attached to the lower edge of the back plate, the foot plate extending forwardly from the back plate, the foot plate generally having a width equal to the width of the back plate.

2. The system as set forth in claim 1 fabricated using flexible materials adapted to include variations in size, materials, shape, form, function and manner of operation, assembly, and use.

* * * * *